US012595036B2

(12) United States Patent
Roy-Bernier et al.

(10) Patent No.: US 12,595,036 B2
(45) Date of Patent: Apr. 7, 2026

(54) RIM-DRIVEN MOTOR FOR PERSONAL WATERCRAFT

(71) Applicant: TAIGA MOTORS INC., Lasalle (CA)

(72) Inventors: Clovis Roy-Bernier, Lasalle (CA); Paul Bruneau, Lasalle (CA)

(73) Assignee: TAIGA MOTORS INC., Lasalle (CA)

( * ) Notice: Subject to any disclaimer, the term of this patent is extended or adjusted under 35 U.S.C. 154(b) by 428 days.

(21) Appl. No.: 18/131,585

(22) Filed: Apr. 6, 2023

(65) Prior Publication Data

US 2023/0322349 A1 Oct. 12, 2023

Related U.S. Application Data

(60) Provisional application No. 63/328,774, filed on Apr. 8, 2022.

(51) Int. Cl.
*B63H 21/17* (2006.01)
*B63H 11/08* (2006.01)
(Continued)

(52) U.S. Cl.
CPC ..... *B63H 21/17* (2013.01); *B63H 21/24* (2013.01); *B63H 21/383* (2013.01); *B63H 23/24* (2013.01); *B63H 2011/081* (2013.01)

(58) Field of Classification Search
CPC ..... B63H 21/17; B63H 21/24; B63H 21/383; B63H 23/24; B63H 2011/081; B63H 21/393
See application file for complete search history.

(56) References Cited

U.S. PATENT DOCUMENTS 5,306,183 A * 4/1994 Holt ..... H02K 21/14 440/6
8,911,271 B2 12/2014 Shibayama
(Continued)

FOREIGN PATENT DOCUMENTS

EP 3009342 4/2016
GB 2489522 3/2012

OTHER PUBLICATIONS

Pan et al., "Coupling design and performance analysis ofrim-driven integrated motor propulsor" Semantic Scholar, 2016, DOI: 10.1109/OCEANSAP.2016.7485456, https://www.semanticscholar.org/paper/Coupling-design-and-performance-analysis-of-motor-Pan-Cheng.
(Continued)

*Primary Examiner* — Stephen P Avila
(74) *Attorney, Agent, or Firm* — NORTON ROSE FULBRIGHT CANADA LLP

(57) ABSTRACT

A personal watercraft comprises a deck having coupled thereto a hull defining a bottom wall, a rear wall and a water intake extending from the bottom wall to the rear wall, and a jet propulsion system. The jet propulsion system comprises a housing coupled to the rear wall and defining an inlet to receive water from the water intake, a venturi, and an outlet to expel the water, and comprises a rim-driven motor disposed within the housing between the inlet and the venturi. The rim-driven motor defines a center axis and comprises a stator coupled to the housing, a rotor disposed radially inwardly of the stator relative to the center axis, and impeller blades coupled to the rotor and projecting towards the center axis, the rotor and the impeller blades rotatable about the center axis to draw the water via the inlet and expel the water via the outlet.

19 Claims, 6 Drawing Sheets

(51) Int. Cl.

| | |
|---|---|
| ***B63H 21/00*** | (2006.01) |
| ***B63H 21/38*** | (2006.01) |
| ***B63H 23/24*** | (2006.01) |

(56) References Cited

U.S. PATENT DOCUMENTS

| | | | | |
|---|---|---|---|---|
| 10,919,608 | B1 * | 2/2021 | Kunanec ..... | B63H 11/08 |
| 2013/0115833 | A1 | 5/2013 | Suzuki et al. | |

OTHER PUBLICATIONS

Thor Peter Andersen, "Design of Rim Driven Waterjet Pump for Small Rescue Vessel" Gothenburg, Sweden 2014, Department of Shipping and Marine Technology, Chalmers University of Technology.

"Yamaha's HARMO Electric Outboard System Makes U.S. Debut at IBEX", BusinessWire, Kennesaw Ga, Yamaha Marine introduced its HARMO electric outboard system to the U.S., 2021 International Boatbuilders Exhibition and Conference (IBEX ).

* cited by examiner

RIM-DRIVEN MOTOR FOR PERSONAL WATERCRAFT

CROSS-REFERENCE TO RELATED APPLICATIONS

This application claims priority from U.S. Provisional Patent Application No. 63/328,774, filed Apr. 8, 2022, which is incorporated by reference in its entirety herein.

TECHNICAL FIELD

The application relates generally to personal watercraft and, more particularly, to electric motors for personal watercraft.

BACKGROUND

For watercraft, and in particular personal watercraft (PWC), components are arranged and positioned in consideration of their effect on the center of gravity of the PWC, both with and without a driver and/or passenger. In PWC which use electric power as a power source, one or more electric motors are provided. The positioning of the motors influences the center of gravity of the PWC and how other components of the PWC must be configured, thus also influencing complexity of assembly and packaging.

SUMMARY

In accordance with one aspect, there is provided a personal watercraft comprising a deck, a hull coupled to the deck, the hull defining a bottom wall, a rear wall and a water intake extending from the bottom wall to the rear wall, and a jet propulsion system to propel the personal watercraft. The jet propulsion system comprises a housing coupled to the rear wall of the hull, the housing defining an inlet to receive water from the water intake, a venturi, and an outlet to expel the water from the housing, and a rim-driven motor disposed within the housing between the inlet and the venturi, the rim-driven motor defining a center axis and comprising a stator coupled to the housing, a rotor disposed radially inwardly of the stator relative to the center axis, and impeller blades coupled to the rotor and projecting towards the center axis, the rotor and the impeller blades being rotatable about the center axis relative to the housing to draw the water into the housing via the inlet and expel the water from the housing via the outlet.

In some embodiments, the deck and the hull form an interior space of the personal watercraft, and the housing of the jet propulsion system is disposed outside of the interior space of the personal watercraft.

In some embodiments, the interior space of the personal watercraft stores a battery pack to provide electrical power to the rim-driven motor.

In some embodiments, the hull defines at least one through-hole to accommodate electrical links between a motor control unit and the rim-driven motor.

In some embodiments, the at least one through-hole is formed in the rear wall of the hull.

In some embodiments, the motor control unit is mounted proximate to the rear wall.

In some embodiments, the jet propulsion system further comprises a nozzle pivotally coupled to the housing adjacent to the outlet, the nozzle configured to generate a directionally controlled jet of water from the water expelled via the outlet.

In some embodiments, the jet propulsion system further comprises a plurality of stator vanes coupled to the housing between the impeller blades and the outlet.

In some embodiments, the stator and the rotor are annular-shaped, the stator has circumferentially disposed thereon a plurality of windings configured to generate a magnetic flux, and the rotor comprises at least one magnetic element configured to generate a magnetic field adapted to interact with the magnetic flux to cause rotation of the rotor and of the impeller blades.

In some embodiments, the rim-driven motor further comprises a shaft rotatably mounted to the stator and coaxially therewith, the shaft having an inner surface and an outer surface opposite to the inner surface, the impeller blades mounted to the inner surface and the rotor fitted to the outer surface.

In some embodiments, the impeller blades are mounted to the inner surface of the shaft using at least one coupling member configured to transmit torque from the shaft to the impeller blades as the shaft rotates about the center axis.

In some embodiments, each impeller blade extends from a first end to a second end, the first end mounted to the inner surface of the shaft via the at least one coupling member and the second end positioned towards the center axis.

In some embodiments, the at least one coupling member comprises a first keyed joint provided on the inner surface of the shaft and a second keyed joint provided on the first end of the impeller blade, the first keyed joint configured to mate with the second keyed joint.

In some embodiments, the housing is in sealing engagement with the shaft through a first annular seal and a second annular seal fitted to the outer surface of the shaft.

In some embodiments, the personal watercraft further comprises a cooling member disposed within the housing adjacent the stator, the cooling member comprising one or more fluid passages configured to convey a cooling fluid therethrough.

In some embodiments, the fluid passages are configured to convey therethrough the cooling fluid comprising the water drawn by the impeller blades into the housing.

In accordance with another aspect, there is provided a jet propulsion system to propel a personal watercraft, comprising a housing to couple to a rear wall of a hull of the personal watercraft, the housing defining an inlet to receive water from a water intake extending from a bottom wall of the hull to the rear wall, a venturi, and an outlet to expel the water from the housing, and a rim-driven motor disposed within the housing between the inlet and the venturi, the rim-driven motor defining a center axis and comprising a stator coupled to the housing, a rotor disposed radially inwardly of the stator relative to the center axis, and impeller blades coupled to the rotor and projecting towards the center axis, the rotor and the impeller blades being rotatable about the center axis relative to the housing to draw the water into the housing via the inlet and expel the water from the housing via the outlet.

In some embodiments, the housing is disposed outside of an interior space of the personal watercraft, the interior space formed by the hull and a deck of the personal watercraft.

In some embodiments, the rim-driven motor receives electrical power from a battery pack stored in the interior space of the personal watercraft.

In some embodiments, the rim-driven motor is controlled by a motor control unit and is connected thereto via one or more electrical links, the one or more electrical links between the motor control unit and the rim-driven motor being accommodated by at least one hole defined in the housing.

In some embodiments, the jet propulsion system further comprises a nozzle pivotally coupled to the housing adjacent the outlet, the nozzle configured to generate a directionally controlled jet of water from the water expelled via the outlet.

In some embodiments, the jet propulsion system further comprises a plurality of stator vanes coupled to the housing between the impeller blades and the outlet.

In some embodiments, the stator and the rotor are annular-shaped, the stator has circumferentially disposed thereon a plurality of windings configured to generate a magnetic flux, and the rotor comprises at least one magnetic element configured to generate a magnetic field adapted to interact with the magnetic flux to cause rotation of the rotor and the impeller blades.

In some embodiments, the jet propulsion system further comprises a shaft rotatably mounted within the stator and coaxially therewith, the shaft having an inner surface and an outer surface opposite to the inner surface, the impeller blades mounted to the inner surface and the rotor fitted to the outer surface.

In some embodiments, the impeller blades are mounted to the inner surface of the shaft using at least one coupling member configured to transmit torque from the shaft to the impeller blades as the shaft rotates about the center axis.

In some embodiments, each impeller blade extends from a first end to a second end, the first end mounted to the inner surface of the shaft via the at least one coupling member and the second end positioned towards the center axis.

In some embodiments, the at least one coupling member comprises a first keyed joint provided on the inner surface of the shaft and a second keyed joint provided on the first end of the impeller blade, the first keyed joint configured to mate with the second keyed joint.

In some embodiments, the housing is in sealing engagement with the shaft through a first annular seal and a second annular seal fitted to the outer surface of the shaft.

In some embodiments, the jet propulsion system further comprises a cooling member disposed within the housing adjacent the stator, the cooling member comprising one or more fluid passages configured to convey a cooling fluid therethrough.

In some embodiments, the fluid passages are configured to convey therethrough the cooling fluid comprising the water drawn by the impeller blades into the housing.

In accordance with another aspect, there is provided a method of assembling a personal watercraft. The method comprises coupling a housing of a rim-driven motor to a rear wall of a hull of the personal watercraft, the housing defining an inlet to receive water from a water intake extending from a bottom wall of the hull to the rear wall, a venturi, and an outlet to expel the water from the housing, the rim-driven motor comprising impeller blades to draw the water into the housing via the inlet and expel the water from the housing via the outlet, and electrically connecting a battery of the personal watercraft to the rim-driven motor using electrical links accommodated by through-holes formed in the hull.

In some embodiments, electrically connecting the battery of the personal watercraft to the rim-driven motor comprises electrically connecting a motor control unit of the personal watercraft to the rim-driven motor.

Many further features and combinations thereof concerning embodiments described herein will appear to those skilled in the art following a reading of the instant disclosure.

DESCRIPTION OF THE DRAWINGS

Reference is now made to the accompanying figures in which.

DETAILED DESCRIPTION

The following disclosure relates, in part, to straddle seat vehicles drivingly engaged to drive systems for effecting propulsion of the vehicles in both a forward and reverse direction. The drive systems may comprise a rim-driven electric motor for driving a jet pump to effect propulsion. In some embodiments, the straddle seat vehicles described herein may comprise powersport vehicles that may be operated off-road and/or in relatively rugged environments. Examples of suitable off-road powersport vehicles include snowmobiles, personal watercraft (PWCs), all-terrain vehicles (ATVs), and utility task vehicles (UTVs). As used herein, the term off-road vehicle refers to vehicles to which at least some regulations, requirements or laws applicable to on-road vehicles do not apply.

The terms "connected", "connects" and "coupled to" may include both direct connection and coupling (in which two elements contact each other) and indirect connection and coupling (in which at least one additional element is located between the two elements).

The following disclosure relates, in part, to electric watercraft, but could also be applicable to hybrid (electric and combustion) watercraft. Examples of suitable electric watercraft include personal watercraft (PWC) having a straddle seat for accommodating an operator and optionally one or more passengers.

Figure 1:
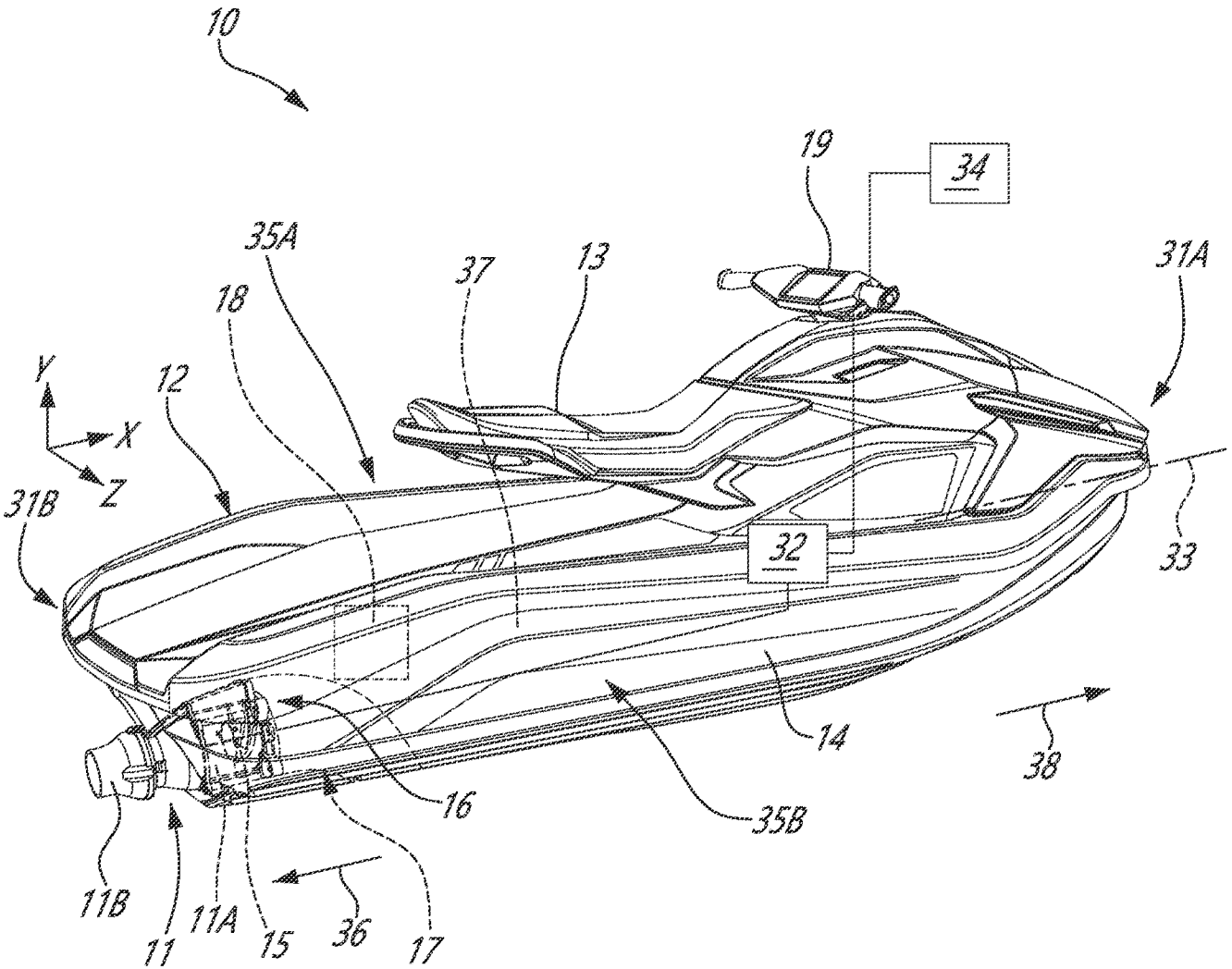
FIG. 1 is a perspective view of a watercraft, according to one example of the present disclosure.

FIG. 1 illustrates a watercraft 10 of a type preferably used for transporting one or more passengers over a body of water. The watercraft 10 is therefore sometimes referred to herein as a "personal watercraft 10" or "PWC 10". The PWC 10 of FIG. 1 is electrically powered. An upper portion of the PWC 10 is formed of a deck 12 including a straddle seat 13 for accommodating a driver of the PWC 10 and optionally one or more passengers. A lower portion of the PWC 10 is formed of a hull 14 which sits in the water. The hull 14 and the deck 12 enclose an interior volume 37 of the PWC 10 which provides buoyancy to the PWC 10 and houses components thereof. A non-limiting list of components of the PWC 10 that may be located in the interior volume 37 include one or more electric batteries 18 and other components for an electric drive system of the PWC 10. One example of an electric drive system for a PWC is described in U.S. application Ser. No. 17/569,867 filed Jan. 6, 2022 and entitled "DRIVE UNIT FOR ELECTRIC VEHICLE", the entire contents of which are incorporated herein by reference. The hull 14 may also include strakes and chines which provide, at least in part, riding and handling characteristics of the PWC 10. The interior volume 37 may also include any other components suitable for use with PWC 10, such as storage compartments, for example.

Figure 2A:
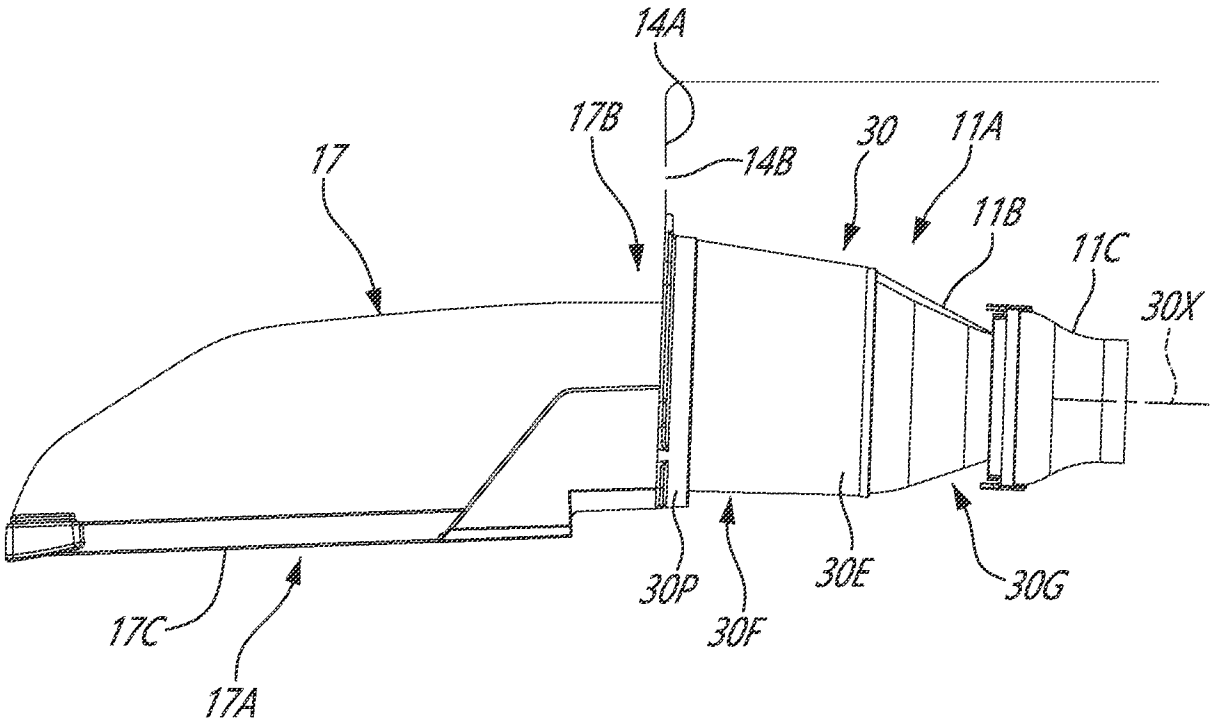
FIG. 2A is a side elevational view of a jet propulsion system of the watercraft of FIG. 1, according to one embodiment of the present disclosure.

The PWC 10 includes a jet propulsion system 11 to create a pressurized jet of water which provides thrust to propel the PWC 10 through the water. The jet propulsion system 11 includes a jet pump 11A disposed in the water to draw water through a water intake (also referred to herein as an "intake duct") 17 on an underside of the hull 14. Referring to FIG. 2A in addition to FIG. 1, the water intake 17 is a passage formed by walls of the hull 14, and extends downstream from an opening in the underside of the hull 14 to an upright, internal rear wall 14A of the hull 14. The water intake 17 is in the form of a ramp which extends from a water intake inlet 17A at the opening in the underside of the hull 14, to a water intake outlet 17B at internal rear wall 14A. The water intake inlet 17A is covered by a grate 17C or other body to prevent the ingress of debris into the water intake 17. Water is ejected from the jet pump 11A via a venturi 11B which further accelerates the water (due to the venturi 11B having a decreasing or tapered cross-sectional configuration along an axial extent thereof, where the venturi's exit diameter being smaller than its entrance diameter) to provide additional thrust. The accelerated water jet is ejected from the venturi 11B through a pivoting steering nozzle 11C which is directionally controlled by the driver with a steering mechanism 19 to provide a directionally controlled jet of water to propel and steer the PWC 10.

As will be described further with reference to FIG. 3A, the electric drive system of the PWC 10 may include a rim-driven motor 16 configured to drive the jet propulsion system 11. The electric drive system also includes the batteries 18 (referred hereinafter in the singular) for providing electric current to and driving the rim-driven motor 16. In some embodiments, the battery 18 may be a lithium ion or other type of battery 18. The operation of the rim-driven motor 16 and the delivery of drive current to the rim-driven motor 16 may be controlled by a controller 32 based on an actuation by the driver of an accelerator 34, sometimes referred to as a "throttle", on the steering mechanism 19, among other inputs. The controller 32 may include, for example, a computer including one or more data processors and non-transitory machine-readable memory storing instructions for execution by the one or more data processors. In some embodiments, the controller 32 includes a motor control unit to control the rim-driven motor 16. In some embodiments, the rim-driven motor 16 is a three-phase motor and the motor control unit includes a power inverter to convert the DC power from the battery 18 into three-phase AC power to drive the rim-driven motor 16.

Still referring to FIG. 1, the PWC 10 moves along a rear or aft direction of travel 36 and along a forward direction of travel 38. The forward direction of travel 38 is the direction along which the PWC 10 travels in most instances when displacing. The aft direction of travel 36 is the direction along which the PWC 10 displaces only occasionally, such as when it is reversing. The PWC 10 includes a bow 31A and a stern 31B defined with respect to the aft and forward directions of travel 36, 38, in that the bow 31A is positioned ahead of the stern 31B relative to the forward direction of travel 38, and that the stern 31B is positioned astern of the bow 31A relative to the aft direction of travel 36. The PWC 10 defines a longitudinal center axis 33 that extends between the bow 31A and the stern 31B. A port side 35A and a starboard side 35B of the PWC 10 are defined on opposite lateral sides of the center axis 33. The positional descriptors "front", "aft" and "rear" and terms related thereto are used in the present disclosure to describe the relative position of components of the PWC 10. For example, if a first component of the PWC 10 is described herein as being in front of, or forward of, a second component, the first component is closer to the bow 31A than the second component. Similarly, if a first component of the PWC 10 is described herein as being aft of, or rearward of, a second component, the first component is closer to the stern 31B than the second component. The PWC 10 also includes a three-axes frame of reference that is displaceable with the PWC 10, where the Y-axis is parallel to the vertical direction, the X axis is parallel to the center axis 33, and the Z-axis is perpendicular to both the X and Y axes and defines a lateral direction between the port and starboard sides 35A, 35B. Features and components are described and shown in the present disclosure in relation to the PWC 10, but the present disclosure may also be applied to different types of watercraft 10, such as other boats or other vessels, used to transport people and/or cargo.

Figure 2B:
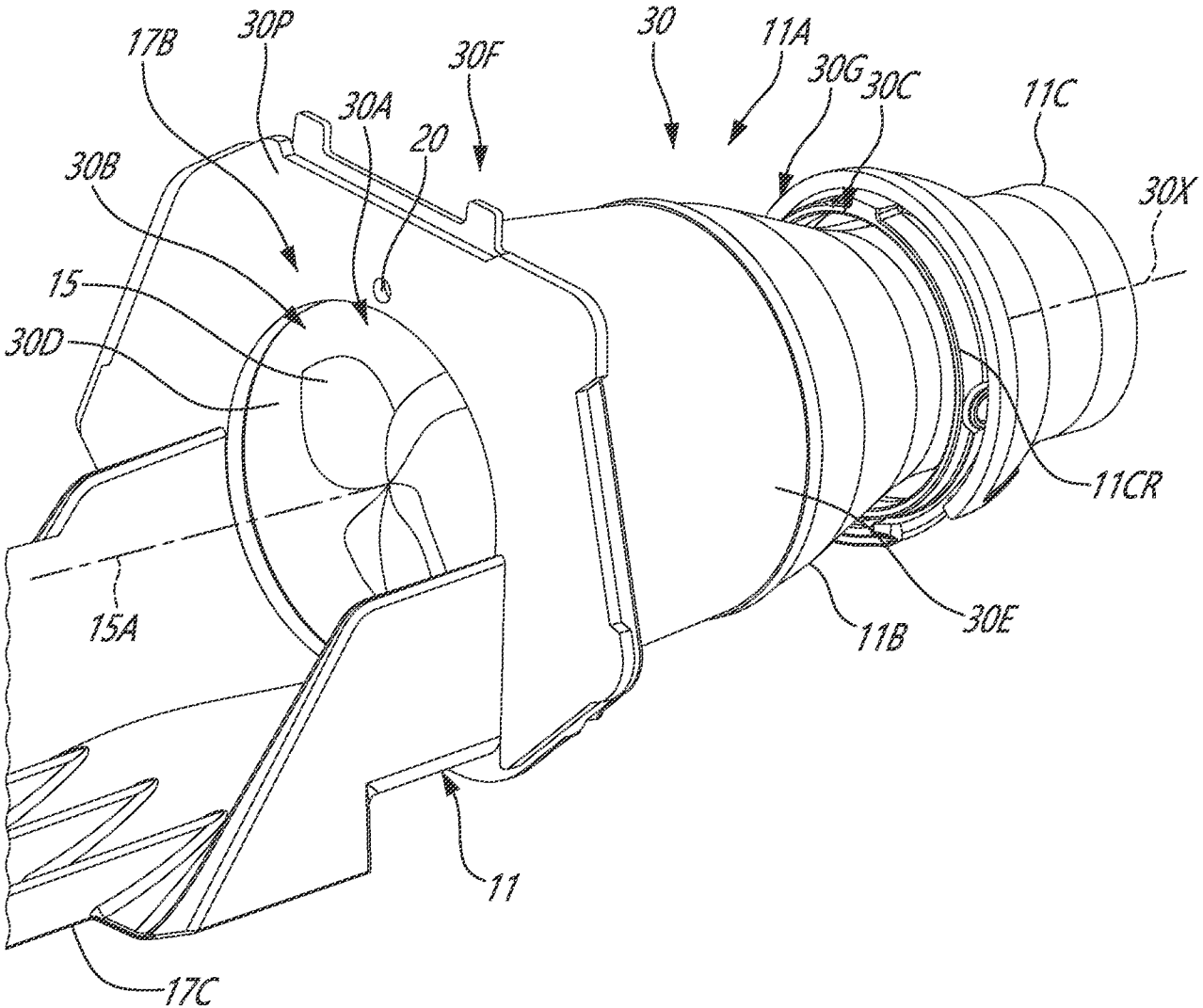
FIG. 2B is a rear perspective view of the jet propulsion system of FIG. 2A, according to one embodiment of the present disclosure.

FIGS. 2A and 2B show features of the jet propulsion system 11, including the water intake 17 and the jet pump 11A. The jet pump 11A includes the impeller 15, stator vanes (not shown), the venturi 11B (sometimes referred to as a nozzle), and the pivoting steering nozzle 11C. The jet pump 11A has, or is formed by, a housing 30 (sometimes referred to in this specification as the "jet pump housing"). The housing 30 is a hollow body which delimits an interior 30A or cavity. The housing interior 30A contains the impeller 15 and the stator vanes. In some embodiments, the housing 30 forms the venturi 11B. Alternatively, the venturi 11B may be a component separate from the housing 30. The housing 30 is a stationary component whose position with respect to the hull 14 is fixed, and which moves with the PWC 10 through the water. Referring to FIGS. 2A and 2B, the housing 30 is fixed in position by being mounted to the internal rear wall 14A of the hull 14 within a jet pump tunnel (not shown) formed along an underside of the hull 14. For this purpose, the housing 30 includes a mounting plate 30P or flange which is abutted against the internal rear wall 14A of the hull 14 which delimits part of the water intake 17. The housing 30 is mounted to the hull 14 by attaching the mounting plate 30P to the internal rear wall 14A, for example with fasteners such as bolts (not shown). One side of the upright internal rear wall 14A faces toward, and partially delimits, the interior volume 37 of the PWC 10.

Some or all of the housing 30 may be partly or completely submerged in water during one or more operating phases of the PWC 10. For example, when the PWC 10 is floating in the water or travelling at relatively low speeds through the water in the forward direction, some or all of the housing 30 may be partly or completely submerged in the water. The housing 30 is an elongated body which extends between an inlet 30B through which the water enters the interior 30A via the water intake 17, and an outlet 30C through which the water is expelled from the interior 30A by the impeller 15. The inlet 30B of the housing 30 is in fluid communication, or coincident, with the water intake outlet 17B of the water intake 17. This description of the inlet 30B and the outlet 30C applies even if the direction of water flowing through the interior 30A is reversed, such as when the PWC 10 is reversing by reversing the direction of the impeller 15 and water travels through the interior 30A of the housing 30 from the outlet 30C to the inlet 30B.

The interior 30A of the housing 30 is in part delimited by an inner wall 30D. In the exemplary illustrated embodiment where the housing 30 is an annular body that defines a housing center axis 30X, the inner wall 30D is an annular body with a circumferential surface. The inner wall 30D may be a component which experiences wear and which may be replaced. The housing 30 has an outer wall 30E that is spaced radially outwardly from inner wall 30D. The outer wall 30E defines the external surface of the housing 30 and may be submerged in water during one or more operating phases of the PWC 10, such as when the PWC 10 is floating or travelling at relatively low forward speeds. Thus, both the inner wall 30D and the outer wall 30E are configured to be exposed to water during one or more operating phases of the PWC 10. More specifically, the water may flow through the interior 30A and thus along or against the inner wall 30D when the PWC 10 is being used, and the outer wall 30E may be partly or completely submerged in water when the PWC 10 is being used. A thickness of the housing 30 may be defined as the distance separating the inner wall 30D from the outer wall 30E, when measured along a line that is normal to aligned surfaces of the inner and outer walls 30D, 30E, or when measured along a line that is radial to housing center axis 30X of the cylindrical housing 30.

The housing 30 encloses or houses the impeller 15 and other components such as impeller blades, stator vanes, and the rim-driven motor 16 which may be mounted at least partially within the interior 30A, as described in greater detail below. The impeller 15 is positioned within the interior 30A and is rotatable about an impeller axis 15A to pressurize the water and convey it through the housing 30. The impeller axis 15A is coaxial with the housing center axis 30X. The rotation of the impeller 15 functions to draw the water into the interior 30A via the inlet 30B and to expel the water from the outlet 30C, when the PWC 10 is travelling in the forward direction. Referring to FIG. 2B, the impeller 15 is positioned axially between the inlet 30B and the outlet 30C of the housing 30, relative to the impeller axis 15A and the housing center axis 30X. The impeller 15 may be positioned elsewhere with respect to the inlet and outlet 30B, 30C. For example, in an alternate embodiment, the impeller 15 is positioned at the inlet 30B. In another possible embodiment, the impeller 15 is positioned at the outlet 30C.

The housing 30 includes an upstream portion 30F and a downstream portion 30G. During forward travel of the PWC 10, the water flows through the interior 30A of the housing 30 from the upstream portion 30F to the downstream portion 30G. In an embodiment, an example of which is shown in FIGS. 2A and 2B, the upstream portion 30F is mounted to the downstream portion 30G, such that the upstream and downstream portions 30G, 30F form two separate components which make up the housing 30. In an alternate embodiment, the upstream and downstream portions 30G, 30F are integral with one another and form a one-piece or monolithic housing 30. The inlet 30B of the housing 30 is defined in the upstream portion 30F, and the outlet 30C is defined in the downstream portion 30G. The upstream portion 30F may house the rim driven motor 16 and have an internal diameter which remains substantially constant along a length of the upstream portion 30F defined along the housing center axis 30X. The downstream portion 30G may form the venturi 11B and have an internal diameter which decreases along a length of the downstream portion 30G defined along the housing center axis 30X, such that the downstream portion 30G narrows in diameter or converges toward the outlet 30C. Other shapes for the upstream and downstream portions 30F, 30G are possible.

Still referring to FIGS. 2A and 2B, the pivoting steering nozzle 110 is mounted to the housing 30 adjacent to the outlet 30C, such that the nozzle 110 is integrated with the rim-driven motor 16. A pivot ring 11CR is mounted to the steering nozzle 110, and is displaceable in order to cause displacement of the steering nozzle 110 to provide a directionally controlled jet of water to propel and steer the PWC 10. In an alternate embodiment, the jet propulsion system 11 uses a mechanism other than the steering nozzle 110 to direct the PWC 10, such as a rudder or guide vane.

Figure 3A:
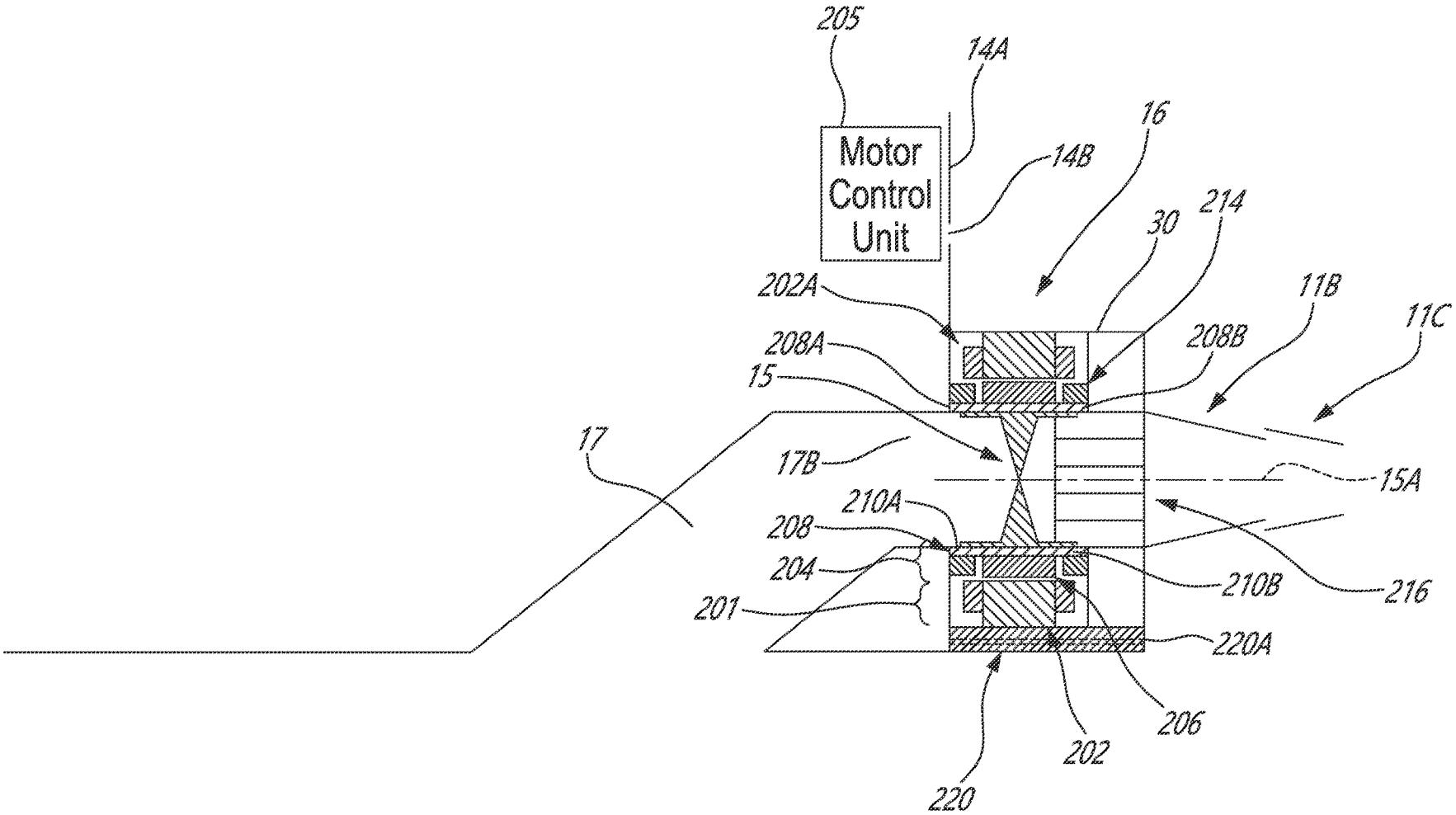
FIG. 3A is a cross-sectional view of the jet propulsion system of FIG. 2A showing a rim-driven motor, according to one embodiment of the present disclosure.

Referring now to FIG. 3A in addition to FIGS. 2A and 2B, the rim-driven motor 16 is provided as a single unit that is rigidly attached to the hull 14 at the water intake outlet 17B of the water intake 17. The rim-driven motor 16 is disposed at least partially within the interior 30A of the housing 30 and is arranged to rotationally drive the impeller 15 about the impeller axis 15A. The rim-driven motor 16 comprises a stator assembly 201 and a rotor assembly 204.

The stator assembly 201 includes an annular-shaped stator 202 positioned within the housing 30, with a center axis (not shown) of the stator 202 coaxial with the housing center axis 30X, and thus with the impeller axis 15A. The stator 202 is fixed in position within the housing 30 using any suitable means. For example, the stator 202 may coupled to the inner wall 30D of the housing 30 using coupling or attachment means including, but not limited to, fasteners such as nuts and bolts (not shown). Adhesives may also or instead be used to couple the stator 202 to the inner wall 30D of the housing 30. When so positioned, the stator 202 remains stationary relative to the housing 30. The stator assembly 201 further includes a plurality of windings (or coils) 202A circumferentially disposed on the stator 202. In one embodiment, the windings 202A are copper windings wound onto the stator 202 so as to define an annular row that surrounds the center axis of the stator 202. The windings 202A may be distributed in slots (not shown) formed around the stator 202. In operation, electrical current is supplied to and flows through the windings 202A, resulting in generation of a magnetic flux.

Figure 3B:
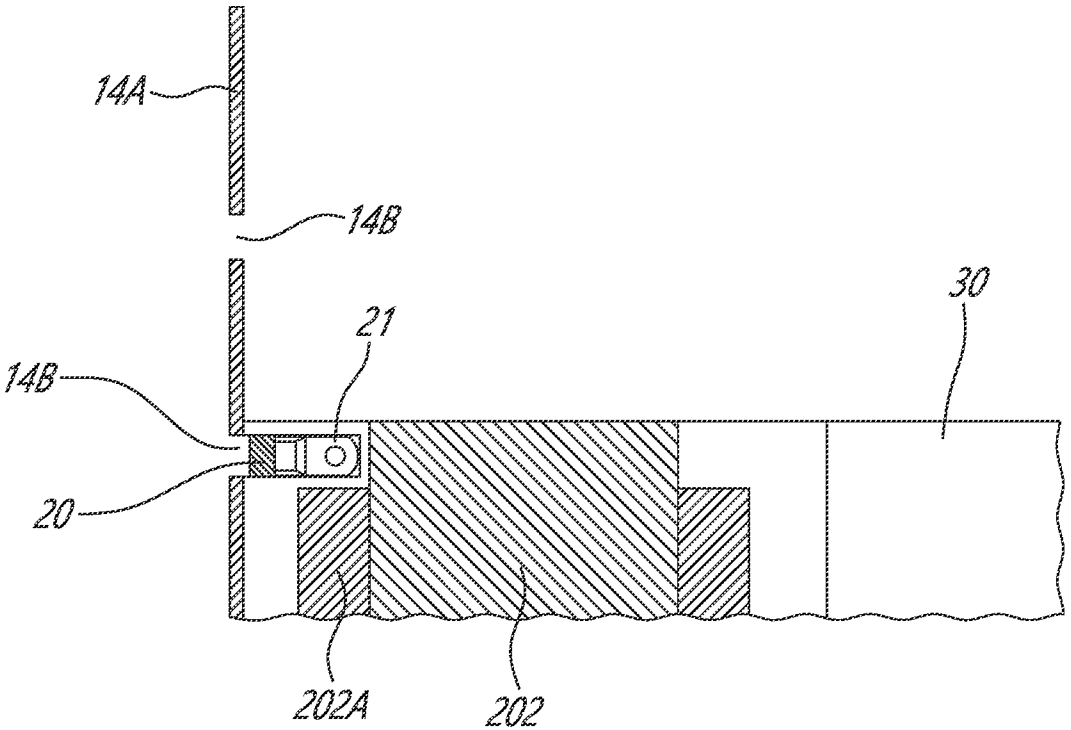
FIG. 3B is a detailed cross-sectional view of part of the rim-driven motor of FIG. 3A, according to one embodiment of the present disclosure.

Electrical current may be supplied to the stator 202 from a motor control unit 205 located in the interior volume 37 of the PWC 10. For example, the rim-driven motor 16 might be a three-phase motor and three-phase electrical current may be generated by an inverter in the motor control unit 205. In some embodiments, the motor control unit 205 might be mounted on, or proximate to, the rear wall 14A to reduce the electrical path length between the inverter and the rim-driven motor 16. This may reduce inductance between the rim-driven motor 16 and the inverter. One or more bores or through-holes as in 14B may be formed in the rear wall 14A to accommodate the electrical connections between the motor control unit 205 and the rim-driven motor 16. As illustrated in FIG. 3B, in some embodiments, these through-holes 14B may (additionally or alternatively) align with one or more holes 20 formed in the housing 30 (e.g., in the mounting plate 30P of FIG. 2B or any other suitable part of the housing 30) that lead to terminals 21 of the rim-driven motor 16. In this way, there might be no electrical wires visible on the exterior of the PWC 10.

The rotor assembly 204 is rotatably mounted within the stator 202 coaxially therewith. The rotor assembly 204 comprises an annular-shaped magnetic rotor core 206 mounted to a motor output shaft 208 of the rim-driven motor 16. The shaft 208 may be coupled to an inner surface of the rotor 206 using fasteners, keyed joints (e.g., dovetails) and/or adhesives, for example. The shaft 208 is a cylindrical rotatable output of the rim-driven motor 16 that transmits motive power (i.e. rotational drive) to the impeller 15. Both the rotor core 206 and the shaft 208 are rotatable about an axis of rotation that is coaxial with the center axis of the stator 202, and thus coaxial with the housing center axis 30X and the impeller axis 15A. In other words, the stator assembly 201 and the rotor assembly 204 are arranged concentrically about the impeller axis 15A (i.e. coaxially). The shaft 208 extends from a first end 208A to a second end 208B. In one embodiment, the first end 208A of the shaft 208 is coupled to the water intake outlet 17B such that the first end 208A is in fluid communication with the water intake outlet 17B. In this manner, the shaft 208 can guide fluid (e.g., water) flowing from the water intake 17 into the impeller 15. Any suitable coupling means (e.g., bearings provided at the first end 208A of the shaft 208, or the like) may be used to rotatably couple the first end 208A of the shaft 208 to the water intake outlet 17B. It should however be understood that other embodiments may apply and the shaft 208 may be connected to the water intake outlet 17B by other connecting means.

Figure 4:
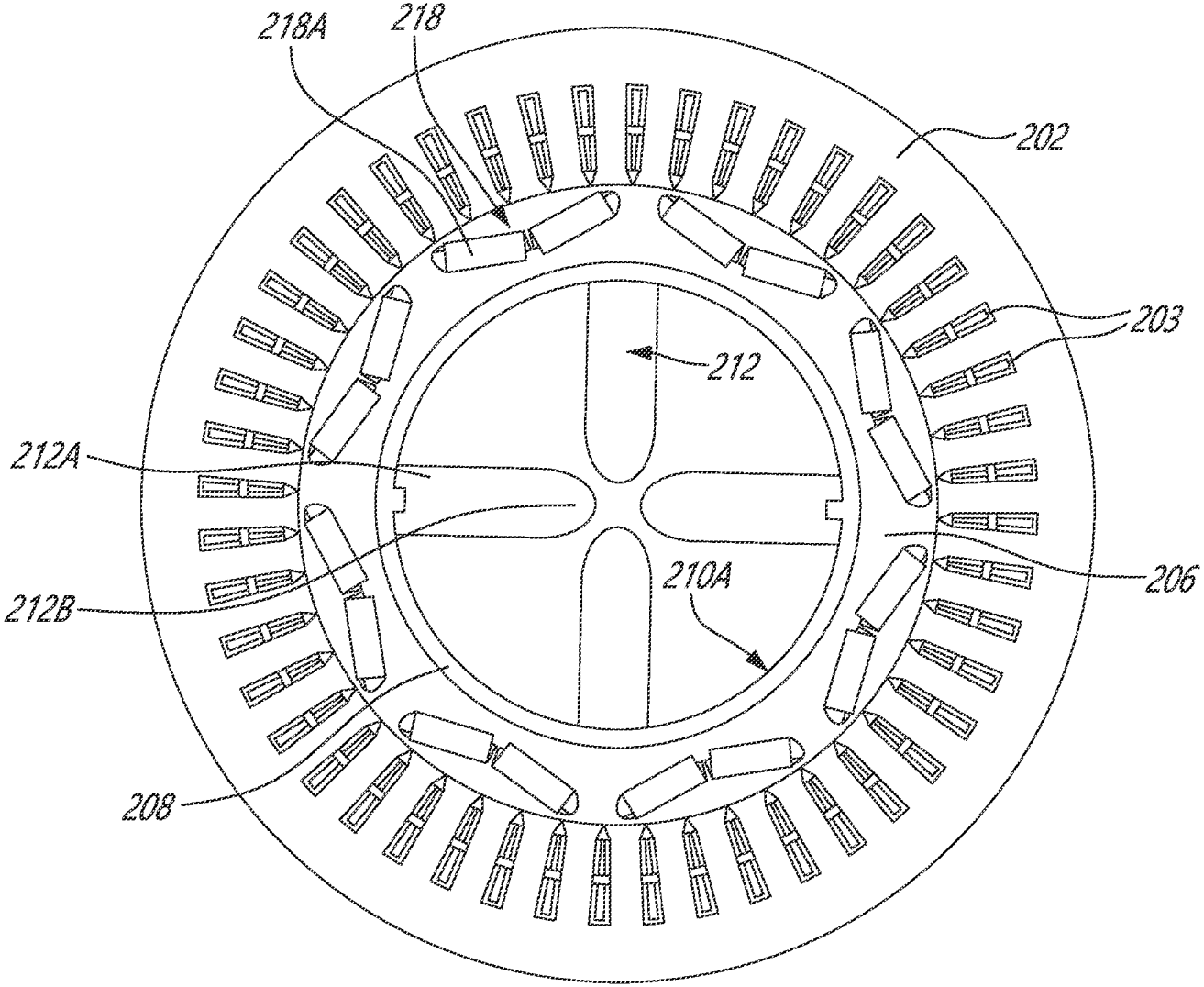
FIG. 4 is a front plan view of the rim-driven motor of FIG. 3A, according to one embodiment of the present disclosure.

The impeller 15 is mounted within the rotor assembly 204. In particular, the impeller 15 is mounted within the shaft 208 such that the shaft 208 transfers motive power from the rim-driven motor 16 to the impeller 15. As illustrated in FIG. 4, the impeller 15 comprises a plurality of impeller blades 212 extending radially (with respect to the impeller axis 15A of FIG. 3A) from the inner surface 210A of the shaft 208 into the interior 30A of the housing 30. The impeller blades 212 are arranged at equally-spaced intervals in the circumferential direction and extend from a first end (also referred to herein as a "base") 212A to a second radially outer end opposite to the base (also referred to herein as a "tip") 212B. The first end 212A of each impeller blade 212 is mounted to the inner surface 210A of the shaft 208 and the second end 212B of each impeller blade 212 is positioned adjacent the impeller axis 15A (and therefore adjacent a center axis of the shaft 208).

The impeller 15 may be coupled to the shaft 208 permanently or removably, using any suitable coupling means, such that movement (i.e. rotation) of the shaft 208 results in corresponding movement of the impeller 15 (i.e. rotation about the impeller axis 15A). Optionally, the impeller 15 may be replaceable in the event that one or more of the impeller blades 212 are damaged. In some embodiments, the impeller blades 212 are provided within a blade housing or rim (not shown) in the form of a ring or tube arranged circumferentially around the impeller blades 212. The impeller 15 may then be coupled to the shaft 208 by coupling the shaft 208 to the blade housing using suitable coupling means (e.g., bolts inserted into a first set of holes formed around the shaft 208 and into a second set of complementary holes formed around the blade housing of the impeller 15). In other embodiments, the impeller 15 is coupled to the inner surface 210A of the shaft 208 using at least one coupling member configured to transmit torque from the shaft 208 to the impeller blades 212 as the shaft 208 rotates. For example, the base 212A of the impeller blades 212 may be coupled to the inner surface 210A of the shaft 208 using keyed joints. For example, dovetails, ridges or teeth (also referred to herein as splines, not shown) may be provided, with a first (e.g., male) spline being formed on the base 212A of the impeller blade 212 and a second (e.g., female) spline being formed on the inner surface 210A of the shaft 208, the first spline configured to mate with the first spline. In other embodiments, a plurality of first splines may be provided on an outer surface of the blade housing and a plurality of second splines may be provided on the inner surface 210A of the shaft 208. Other embodiments may apply.

The rotor core 206 is positioned between the shaft 208 and the stator 202 and is configured to rotate within the stator 202. In one embodiment, the rotor core 206 is spaced from the stator 202 by a gap (not shown). The rotor core 206 is secured to an outer surface 210B of the shaft 208 (i.e. fitted to the outside, or outer surface 210B, of the shaft 208) and is configured to rotate with the shaft 208. In the illustrated embodiment, the housing 30 is in sealing engagement with the shaft 208 using annular seals 214 fitted over the shaft 208. A first (front or upstream) seal 214 is fitted between the housing 30 and the outside of the shaft 208 in front of the rotor core 206, i.e., between the rotor core 206 and the internal rear wall 14A of the hull 14. A second (rear or downstream) seal is fitted between the housing 30 and the outside of the shaft 208 behind the rotor core 206, i.e., between the rotor core 206 and a rear wall (not shown) of the housing 30. In other words, the rotor core 206 is disposed between the seals 214. In some embodiments, the seal 214 includes bearings to enable rotation of the shaft 208 relative to the housing 30.

In operation, the seal 214 may help transfer thrust to the hull 14 and propel the PWC 10. For example, force reacted by the impeller 15 may be transferred from the impeller 15 to the shaft 208, to the seal 214 (which may include bearings), to the housing 30 and finally to the hull 14 at the rear wall 14A. The rear wall 14A may be reinforced or braced to manage the force and distribute the force appropriately. For example, the rear wall 14A may include or be coupled to structural members to manage the force.

As illustrated in FIG. 4, the rotor core 206 comprises one or more magnetic elements 218. In one embodiment, the one or more magnetic elements 218 comprise a plurality of permanent magnets arranged circumferentially around the rotor core 206. As illustrated, the magnetic elements 218 are embedded in the rotor core 206. In other embodiments, the one or more magnetic elements 218 may be arranged on the radially outermost surface of the rotor core 206. The rotor core 206 may be a laminate made of any suitable material (e.g., a steel material including, but not limited to, silicon steel, nickel-iron steel, or the like). In the embodiment of FIG. 4, the magnetic elements 218 comprise pairs of magnets 218A positioned in a V-shape. The V-shape of the magnets 218A may provide increased flux and thus increased power compared to magnets positioned in a straight arrangement and spanning the same circumference of the rotor core 206. More specifically, the V-shape magnets 218A provide a greater magnet surface area than a straight magnet occupying the same rotor surface (i.e. two sides of a triangle as opposed to one straight side). The V-shape topology may also provide higher inductances which provide more torque and wider speed range than a rotor with a straight magnet occupying the same rotor surface.

The one or more magnetic elements 218 may be arranged on the rotor core 206 and positioned relative to the windings 202A of the stator 202 so as to achieve suitable rotation of the rotor assembly 204 and of the impeller 15. In the embodiment of FIG. 4, the magnets 218A comprise eight (8) poles. In the embodiment of FIG. 4, the stator 202 comprises windings 202A formed by forty eight (48) slots 203 with a single layer symmetric winding pattern having four parallel paths (coils) with three (3) turns per coil. A winding pattern having three turns per coil may prove more practical for automated mass-manufacturing, in addition to providing an increased inductance compared to a winding pattern having less turns per coil. The increased inductance may in turn provide a smoother current supply making the motor 16 easier to control while limiting the power via a voltage limit.

Other embodiments having different numbers and arrangements of magnets 218 and windings 202A may apply.

In operation, upon electric current being supplied to the windings 202A (e.g., from the batteries 18 and the motor control unit 205), the windings 202A generate a rotating magnetic flux that interacts with a magnetic field generated by the magnetic elements 218. This interaction causes rotation of the rotor core 206 about its axis of rotation, within the stator 202. The shaft 208 to which the rotor core 206 is coupled is also caused to rotate, resulting in rotation of the impeller 15 mounted to the inner surface 210A of the shaft 208. The rotational speed of the impeller 15 may be altered by changing the electric current supplied to the windings 202A.

Referring back to FIG. 3A, a plurality of stator vanes 216 is coupled to the housing 30 adjacent the second end 208B of the shaft 208. The stator vanes 216 are positioned proximate the impeller 15 and extend co-extensively with the impeller axis 15A. The stator vanes 216 project radially inwards from the inner wall 30D of the jet pump housing 30 into the interior 30A of the jet pump housing 30. The shaft 208 guides fluid (e.g., water) flowing from the impeller 15 towards the stator vanes 216. The stator vanes 216 are configured to rectify or straighten the flow of water from the impeller 15 by decreasing the rotational motion of the water prior to the water being expelled from the jet pump housing 30. In this manner, the stator vanes 216 may help to decrease the losses caused by the swirling flow emanating from the rotating impeller 15. In one embodiment, the stator vanes 216 have an airfoil-like cross-sectional configuration. The stator vanes 216 are circumferentially spaced apart to help guide and deswirl the flow of water through the interior 30A of the housing 30. In one embodiment, the stator vanes 216 are present in only the downstream portion 30G of the housing 30, and are located downstream of the impeller 15. As can be seen from FIG. 3A, the venturi 11B and the nozzle 110 are provided adjacent to the outlet (reference 30C in FIG. 2B) of the jet pump housing 30, with the venturi 11B being positioned adjacent the stator vanes 216. In this manner, the rectified flow of water exiting the stator vanes 216 is ejected from the jet pump housing 30 via the venturi 11B and nozzle 110.

The rim-driven motor 16 may be passively cooled due the housing 30 being submerged in water. For example, water may cool the rim-driven motor 16 via the exterior of the housing 30 and via the inner wall 30D of the housing 30. The faster the rim-driven motor 16 is propelling the PWC 10 through the water, the faster water may flow through or adjacent to the housing 30 to provide cooling. In this way, the rate of cooling for the rim-driven motor 16 may scale with rate at which the rim-driven motor 16 is driven. Still referring to FIG. 3A, additional cooling of the rim-driven motor 16 may also be achieved using a cooling member 220 positioned adjacent the underside of the hull (reference 14 in FIG. 1). In the illustrated embodiment, the cooling member 220 is disposed within the jet pump housing 30, proximate the stator 202. The cooling member 220 may however be disposed at any suitable position relative to the rim-driven motor 16. In another embodiment, the cooling member 220 may disposed within a ride plate that is separate from the rim-driven motor 16. The cooling member 220 may comprise one or more fluid passages (or lines) 220A allowing for fluid to be conveyed therethrough towards the rim-driven motor 16 for cooling the components thereof. In one embodiment, the fluid passages 220A allow for water flowing through the interior (reference 30A in FIG. 2A) of the housing 30 (i.e. water drawn through the water intake, reference 17 in FIG. 1) to be conveyed towards the rim-driven motor 16. In another embodiment, the fluid passages 220A may be fluidly isolated from (i.e. not in fluid communication with) the water. The fluid passages 220A may then form a closed cooling loop through which a cooling fluid, such as oil or a water-glycol solution, travels and is conveyed (e.g., from a pump, not shown) towards the rim-driven motor 16 to absorb heat from the motor components. The fluid passages 220A may be formed as internal conduits or volumes present within the body of the housing 30 and may have or assume any shape, orientation and/or position in, or relative to, the housing 30 to achieve their cooling functionality. In some embodiments, the cooling member 220 may convey cooling fluid to other components of the PWC 10, including the battery 18 and the controller 32.

In one embodiment, using a rim-driven motor as in 16 coupled to the end of the water intake 17 at the rear wall 14A (rather than an electric motor provided in whole or in part within the interior volume 37 of the hull 14) may increase the space available in the hull 14. In addition, the rim-driven motor 16 alleviates the need for a drive shaft passing through the water intake 17 for rotationally driving the impeller 15 about the impeller axis 15A. Removal of such a drive shaft that may disturb fluid flow in the water intake 17 and at the inlet 30B of the jet pump housing 30 in turn improves input flow conditions. Assembly and packaging inside the PWC 10 are also simplified. With the removal of a motor and drive shaft from the interior volume 37, more space may be made available for the battery 18. The size and capacity of the battery 18 may be increased as a result. Further, the shape and location of the battery 18 may be simplified as it is no longer constrained by the size and location of a motor and drive shaft. The battery 18 may therefore have a relatively simple shape that is less challenging to manufacture and/or better conforms to the shape of the hull 14. The battery 18 (which might be a relatively heavy component of the PWC 10) may also be placed in a location within the interior volume 37 that improves the center of gravity for the PWC 10. For example, the battery 18 may be placed towards the stern 31B of the PWC 10 (e.g., adjacent to the rear wall 14A) to improve the center of gravity. In addition, using the rim-driven motor 16 described herein allows for the motor weight to be moved backwards (i.e. towards the stern 31B of the PWC 10), thus improving the effect on the center of gravity of the PWC 10. Indeed, the center of gravity is located closer toward the stern 31B than the bow 31A of the PWC 10, which may be beneficial to compensate for the weight of the driver and/or passenger of the PWC 10 which is positioned axially along the center axis (reference 33 in FIG. 1) of the PWC 10 closer to the blow 31A and often leaning toward the bow 31A when using the PWC 10. Moreover, impeller tip losses may be reduced and efficiency improved due to the rim-driven motor 16 being positioned around the impeller 15. Submersion of the rim-driven motor 16 in the water during use may also improve passive cooling of the rim-driven motor 16, thus increasing the motor's performance.

The embodiments described in this document provide non-limiting examples of possible implementations of the present technology. Upon review of the present disclosure, a person of ordinary skill in the art will recognize that changes may be made to the embodiments described herein without departing from the scope of the present technology.

What is claimed is:

1. A personal watercraft comprising:

a deck;

a hull coupled to the deck, the hull defining a bottom wall, a rear wall and a water intake extending from the bottom wall to the rear wall; and a jet propulsion system to propel the personal watercraft, the jet propulsion system comprising:

a housing coupled to the rear wall of the hull, the housing defining an inlet to receive water from the water intake, a venturi, and an outlet to expel the water from the housing; and a rim-driven motor disposed within the housing between the inlet and the venturi, the rim-driven motor defining a center axis and comprising a stator coupled to the housing, a rotor disposed radially inwardly of the stator relative to the center axis, and impeller blades coupled to the rotor and projecting towards the center axis, the rotor and the impeller blades being rotatable about the center axis relative to the housing to draw the water into the housing via the inlet and expel the water from the housing via the outlet, the rim-driven motor further comprising a shaft rotatably mounted to the stator and coaxially therewith, the shaft having an inner surface and an outer surface opposite to the inner surface, the impeller blades mounted to the inner surface and the rotor fitted to the outer surface.

2. The personal watercraft of claim 1, wherein the deck and the hull form an interior space of the personal watercraft, and the housing of the jet propulsion system is disposed outside of the interior space of the personal watercraft.

3. The personal watercraft of claim 2, wherein the interior space of the personal watercraft stores a battery pack to provide electrical power to the rim-driven motor.

4. The personal watercraft of claim 1, wherein the hull defines at least one through-hole to accommodate electrical links between a motor control unit and the rim-driven motor.

5. The personal watercraft of claim 4, wherein the at least one through-hole is formed in the rear wall of the hull.

6. The personal watercraft of claim 4, wherein the motor control unit is mounted proximate to the rear wall.

7. The personal watercraft of claim 1, wherein the jet propulsion system further comprises a nozzle pivotally coupled to the housing adjacent to the outlet, the nozzle configured to generate a directionally controlled jet of water from the water expelled via the outlet.

8. The personal watercraft of claim 1, wherein the jet propulsion system further comprises a plurality of stator vanes coupled to the housing between the impeller blades and the outlet.

9. The personal watercraft of claim 1, wherein the stator and the rotor are annular-shaped, and further wherein the stator has circumferentially disposed thereon a plurality of windings configured to generate a magnetic flux, and the rotor comprises at least one magnetic element configured to generate a magnetic field adapted to interact with the magnetic flux to cause rotation of the rotor and of the impeller blades.

10. The personal watercraft of claim 1, wherein the impeller blades are mounted to the inner surface of the shaft using at least one coupling member configured to transmit torque from the shaft to the impeller blades as the shaft rotates about the center axis.

11. The personal watercraft of claim 10, wherein each impeller blade extends from a first end to a second end, the first end mounted to the inner surface of the shaft via the at least one coupling member and the second end positioned towards the center axis.

12. The personal watercraft of claim 11, wherein the at least one coupling member comprises a first keyed joint provided on the inner surface of the shaft and a second keyed joint provided on the first end of the impeller blade, the first keyed joint configured to mate with the second keyed joint.

13. The personal watercraft of claim 1, wherein the housing is in sealing engagement with the shaft through a first annular seal and a second annular seal fitted to the outer surface of the shaft.

14. The personal watercraft of claim 1, further comprising a cooling member disposed within the housing adjacent the stator, the cooling member comprising one or more fluid passages configured to convey a cooling fluid therethrough.

15. The personal watercraft of claim 14, wherein the fluid passages are configured to convey therethrough the cooling fluid comprising the water drawn by the impeller blades into the housing.

16. A jet propulsion system to propel a personal watercraft, comprising:

a housing to couple to a rear wall of a hull of the personal watercraft, the housing defining an inlet to receive water from a water intake extending from a bottom wall of the hull to the rear wall, a venturi, and an outlet to expel the water from the housing; and a rim-driven motor disposed within the housing between the inlet and the venturi, the rim-driven motor defining a center axis and comprising a stator coupled to the housing, a rotor disposed radially inwardly of the stator relative to the center axis, and impeller blades coupled to the rotor and projecting towards the center axis, the rotor and the impeller blades being rotatable about the center axis relative to the housing to draw the water into the housing via the inlet and expel the water from the housing via the outlet, the rim-driven motor further comprising a shaft rotatably mounted to the stator and coaxially therewith, the shaft having an inner surface and an outer surface opposite to the inner surface, the impeller blades mounted to the inner surface and the rotor fitted to the outer surface.

17. The jet propulsion system of claim 16, wherein the rim-driven motor is controlled by a motor control unit and is connected thereto via one or more electrical links, the one or more electrical links between the motor control unit and the rim-driven motor being accommodated by at least one hole defined in the housing.

18. A method of assembling a personal watercraft, the method comprising:

coupling a housing of a rim-driven motor to a rear wall of a hull of the personal watercraft, the housing defining an inlet to receive water from a water intake extending from a bottom wall of the hull to the rear wall, a venturi, and an outlet to expel the water from the housing, the rim-driven motor comprising impeller blades to draw the water into the housing via the inlet and expel the water from the housing via the outlet, the rim-driven motor further comprising a rotor, a stator, and a shaft rotatably mounted to the stator and coaxially therewith, the shaft having an inner surface and an outer surface opposite to the inner surface, the impeller blades mounted to the inner surface and the rotor fitted to the outer surface; and electrically connecting a battery of the personal watercraft to the rim-driven motor using electrical links accommodated by through-holes formed in the hull.

19. The method of claim 18, wherein electrically connecting the battery of the personal watercraft to the rim-driven motor comprises electrically connecting a motor control unit of the personal watercraft to the rim-driven motor.

* * * * *